United States Patent [19]

Close

[11] Patent Number: 4,962,369

[45] Date of Patent: Oct. 9, 1990

[54] MERCHANDISE SECURITY SYSTEM UTILIZING RF TRANSMITTER

[75] Inventor: Leo R. Close, Sepulveda, Calif.

[73] Assignee: Marcia Israel, Los Angeles, Calif.

[21] Appl. No.: 308,771

[22] Filed: Feb. 9, 1989

[51] Int. Cl.[5] ..... G08B 13/24

[52] U.S. Cl. ..... 340/572; 340/539; 340/568; 340/693

[58] Field of Search ..... 340/572, 693, 539, 568

[56] References Cited

U.S. PATENT DOCUMENTS

| | | | |
|---|---|---|---|
| 3,493,955 | 2/1970 | Minasy | 340/572 |
| 3,713,133 | 1/1973 | Nathans | 340/572 |
| 3,942,829 | 3/1976 | Humble et al. | 70/57.1 |
| 4,134,108 | 1/1979 | Palmer et al. | 340/539 |
| 4,274,083 | 6/1981 | Tomoeda | 340/572 |
| 4,333,072 | 6/1982 | Beigel | 340/572 |
| 4,565,996 | 1/1986 | Close | 340/554 |
| 4,573,042 | 2/1986 | Boyd et al. | 340/539 |
| 4,595,915 | 6/1986 | Close | 340/554 |
| 4,620,182 | 10/1986 | Keifer | 340/568 |
| 4,746,909 | 5/1988 | Israel et al. | 340/568 |

*Primary Examiner*—Glen R. Swann III

*Attorney, Agent, or Firm*—Spensley, Horn, Jubas & Lubitz

[57] ABSTRACT

A security system for monitoring retail merchandise such as garments includes a radio frequency transmitter tag attachable to the garment by a cable passed through a portion of the garment. The cable has one end affixed to the tag housing and a free end slidably disposed in the housing whereby the tag and cable form a variable length closed loop preventing removal of the tag from the garment. The cable includes a pair of conductors insulated from each other and connected between the transmitter circuit and a capacitive discharge power supply inside the tag. An attempt to cut the cable causes the conductors to come into contact thereby energizing the transmitter which transmits a modulated radio frequency signal burst. The capacitive discharge supply is powered by a battery whose longevity approaches shelf life. An arrangement for removing the cable from the tag by authorized personnel is also disclosed.

The security system includes a receiver/processor for receiving and demodulating RF signals and generating an alarm signal if the detected signal falls within a predetermined frequency range.

Also disclosed are alternative embodiments of the security tag as well as arrangements for integrating the security system, or portions thereof, into an existing sensor loop merchandise monitoring system.

19 Claims, 10 Drawing Sheets

MERCHANDISE SECURITY SYSTEM UTILIZING RF TRANSMITTER

CROSS-REFERENCE TO RELATED APPLICATION AND PATENT

Application Ser. No. 902,484 filed Sept. 2, 1986, now U.S. Pat. No. 4,746,909 issued May 24, 1988, for "Modular Security System" (M. Israel and L. R. Close), owned by the assignee of the present application, is related to the present application and is incorporated by reference to the extent hereinafter indicated.

FIELD OF THE INVENTION

The invention relates generally to electronic security and anti-theft systems for protecting articles such as merchandise on display in retail stores, and more particularly to improvements in the monitoring tags attachable to the protected articles and in the apparatus for detecting signals from the tags indicative of an alarm condition.

BACKGROUND OF THE INVENTION

Various electronic security systems are available for monitoring merchandise and discouraging theft from retail establishments. One system in widespread use consists of a transmitter for radiating a radio frequency field throughout a surveillance zone near the store exit; a tag, attached to the protected article, for receiving the transmitted signal and reradiating a signal having a different frequency or other detectable property; and a receiver for detecting the presence of the reradiated signal within the surveillance zone. An early example of such a system is disclosed in U.S. Pat. No. 3,493,955 to A. J. Minasy. The present inventor's U.S. Pat. Nos. 4,565,996 and 4,595,915 disclose improved rebroadcasting systems employing doppler techniques for establishing sharply defined surveillance zones thereby substantially reducing false alarms.

Experience has shown that although the mere presence of a tag on an article tends to deter theft, exit monitoring system do not provide total protection. For example, ways are found to remove the tags even if that results in damage to the merchandise. Such removal, of course, cannot be detected by exit control systems which can only sense the presence of tags within the surveillance zone.

Existing tag detection systems have other drawbacks. For example, although pilferers tend not to risk leaving a store with a tagged article, thefts of tagged items have occasionally succeeded by shielding the tag from the incident radiation while passing through the surveillance zone.

In addition, in clothing stores, monitoring tags are typically attached to garments by tacks which pierce the garment. (See, for example, U.S. Pat. No. 3,942,829 to Humble, et al.) Use of these fasteners can result in damage to the garment even during normal handling. Moreover, the removal of the tags at the checkout counter and their subsequent re-attachment to other garments can be time-consuming processes.

It is, of course, essential that the security system receiver respond only to signals from the tag and not to spurious signals from nearby sources such as electrical equipment, lighting fixtures or power lines subject to voltage changes. Yet despite elaborate efforts to eliminate them, false alarms continue to plague certain existing systems, especially those depending on the detection of amplitude modulated radio frequency signals.

SUMMARY OF THE INVENTION

In accordance with one aspect of the invention, there is provided a security tag which may be attached to an article of merchandise, such as a garment, and which encloses a radio frequency transmitter energizable to emit a burst of RF energy if an attempt is made to tamper with the tag. The transmitter is coupled across a capacitor maintained in a charged condition by a battery. Means, such as a switch, connects the transmitter and capacitor in response to an alarm condition, the energy stored in the capacitor thereby momentarily energizing the transmitter. Since the battery is used only to charge the capacitor, its longevity approaches shelf life.

The tag may also house a rebroadcast antenna to interact with the transmitter and receiver of an exit monitoring system so as to provide total protection.

In accordance with another aspect of the invention, the tag is attached to the protected garment by a cable having one end affixed to the tag and a free end looped through a portion of the garment, such as a sleeve, and held between a main portion of the tag and a movable end portion latched within the main portion. Damage such as that caused by tack attachment systems presently in use is thereby eliminated. A switch inside the tag and connecting the charged capacitor and RF transmitter, senses the position of the end portion of the tag relative to the main portion and any attempt to pry open the tag causes energization of the transmitter. In addition, the cable includes a pair of conductors extending substantially the length of the cable, the ends of the conductors at the fixed end of the cable being connected across the aforementioned switch. Accordingly, any attempt to cut the cable causes the conductors to come into contact with each other thereby energizing the transmitter.

The present invention also provides a novel technique for the reliable, error free detection of the signal broadcast by the tag transmitter. In accordance with this aspect of the invention, an input signal is produced in response to a received RF signal and applied to a digital processor. The processor generates a first train of pulses of equal, predetermined width in response to and at the frequency of the input signal and a second train of pulses in response to and at twice the frequency of the first train. The input signal is entered into a digital memory clocked at the frequency of the second pulse train. The contents of the memory are monitored and an alarm signal is generated when those contents conform to a predetermined pattern which pattern will be present only when the frequency of the input signal is substantially equal to the transmitter modulation frequency. To further restrict alarm conditions and minimize chances of false alarms, the memory may be enabled only periodically for a duration just sufficient to completely load the memory.

According to yet another aspect of the invention, the transmitter and receiver processing techniques of the invention are applied to enhance the operation of the sensor loop system disclosed in above-referenced U.S. Pat. No. 4,746,909.

BRIEF DESCRIPTION OF THE DRAWINGS

The foregoing and other objects, features and advantages of the invention will be apparent from the detailed description below when read in conjunction with the accompanying drawings in which.

DETAILED DESCRIPTION OF THE PREFERRED EMBODIMENTS

Figure 1:
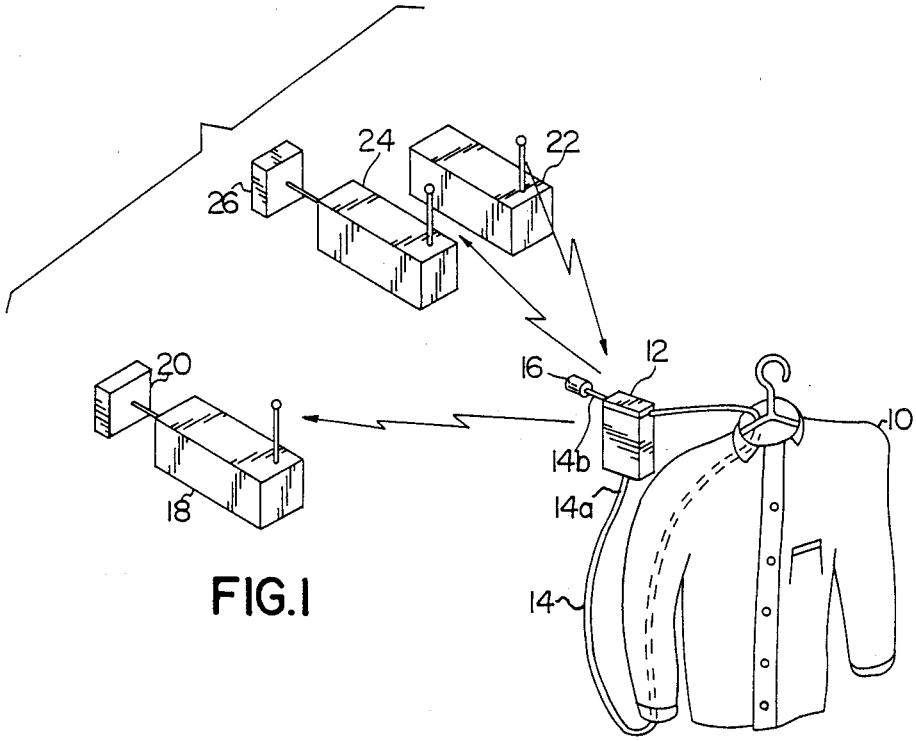
FIG. 1 is a perspective view of the basic components of a merchandise security system in accordance with the present invention.
Figure 2:
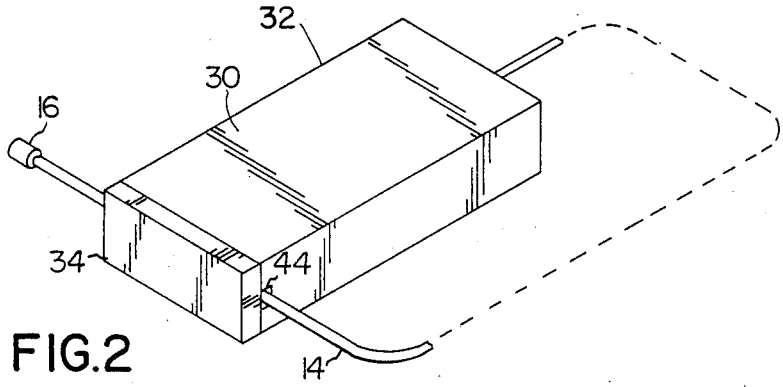
FIG. 2 is a perspective view of a transmitter tag and associated cable used in the system of FIG. 1.

Referring to FIG. 1, there is shown in diagrammatic form the main components of a security system, in accordance with the invention, for protecting retail merchandise such as a garment 10. The system includes a security tag 12 attached to the garment by means of a cable 14 having an end 14*a* affixed to one end of the tag and a free end 14*b* slidably passed through the other end of the tag. A knob 16 secured to the free end of the cable 14 prevents the free end of the cable from being drawn out of the tag. The cable 14 and tag 12 thus form a variable length closed loop which in the example shown in FIG. 1 has been passed through a sleeve of the protected garment 10 so that the tag cannot be removed from the garment without disconnecting the cable from the tag.

The tag encloses a transmitter, the circuitry of which will be described presently, which broadcasts a radio frequency (RF) signal if an attempt is made to cut the cable, if the tag is tampered with, or, in accordance with an alternative embodiment, if the free end is forcibly pulled out of the tag. A highly selective receiver/-processor 18 detects the RF signal and generates an alarm signal which drives a speaker 20.

The tag 12 of the invention may also incorporate rebroadcast circuitry so the tag can be used with existing exit monitoring systems such as those disclosed in the present inventor's U.S. Pat. Nos. 4,565,996 and 4,595,915. As shown in FIG. 1, the basic components of such an exit monitoring system include a transmitter 22 for emitting an interrogating field within a defined surveillance zone adjacent the store exit, and a receiver 24 for intercepting the signal generated by the tag rebroadcast circuitry and for producing an alarm via a speaker 26 or other alarm indicator.

It will be seen from what is broadly delineated in FIG. 1 that the system provides complete protection with the tag-removal detector complementing the exit monitoring system. Moreover, by attaching the tag to the garment by way of a looped cable, damage to the merchandise is avoided.

FIGS. 2 through 8 show the mechanical and electrical details of the new tag and the manner in which authorized removal of the cable from the tag is effected.

Figure 3:
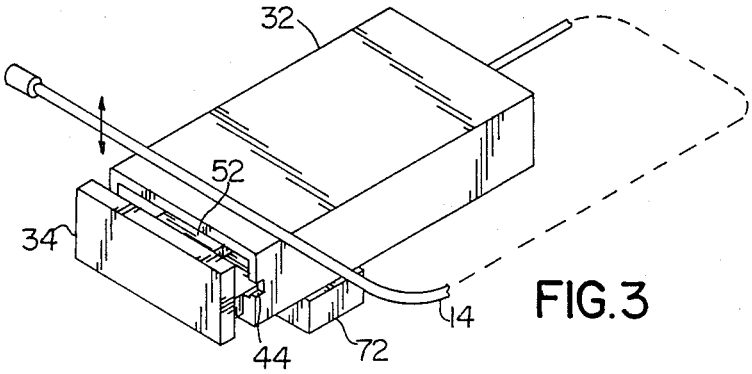
FIG. 3 is a perspective view of the tag of FIG. 2 with the movable end portion of the tag in the open position to permit withdrawal or insertion of the cable.
Figure 5:
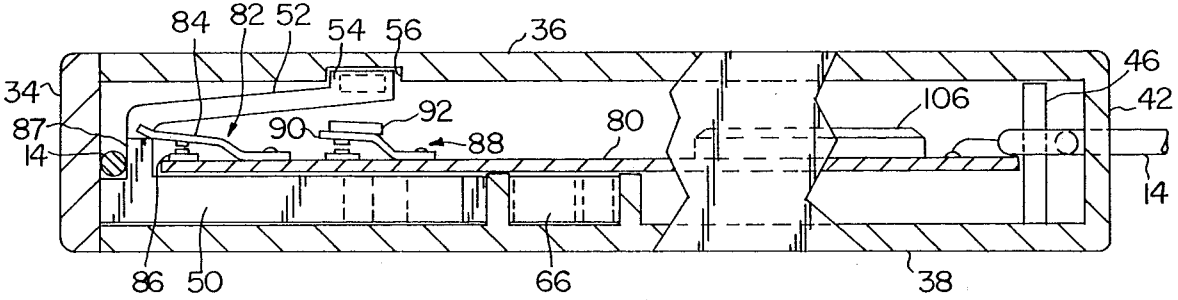
FIG. 5 is a side elevation view, partly in section, of the tag as seen along 5—5 in FIG. 4.
Figure 6:
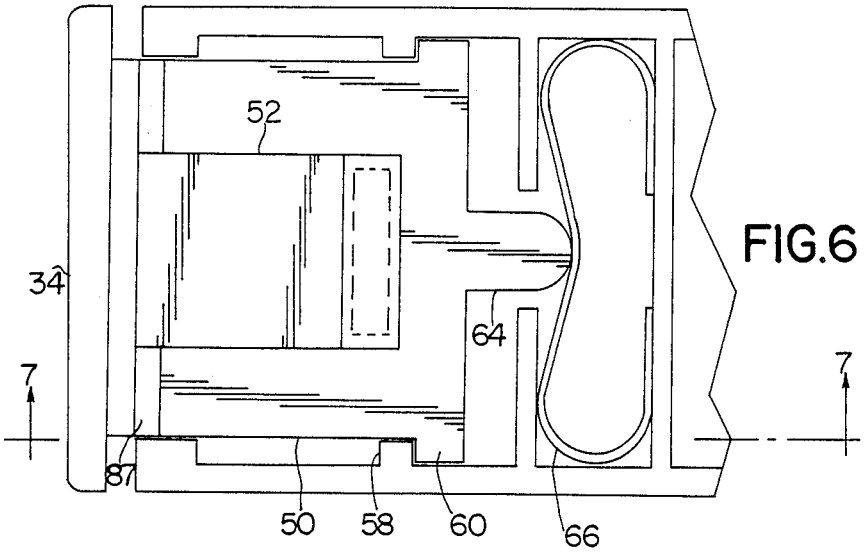
FIG. 6 is a top plan view, partly broken away, of the tag of FIG. 2 with the movable end in the open, unlatched position.
Figure 7:
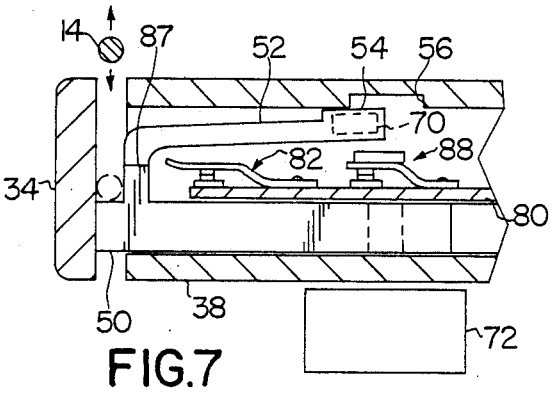
FIG. 7 is a side elevation view, partly in section, of the tag as seen along 7—7 in FIG. 6.

The tag 12 includes a housing 30 having a main portion 32 and a movable end portion 34 which is normally in a closed, latched position within the main portion but which can be withdrawn from the main portion to a limited extent as shown in FIGS. 3, 6 and 7. The main portion of the housing has top, bottom, side and end walls 36, 38, 40 and 42, respectively, the side walls having notches 44 (FIG. 3) for receiving the free end 14*b* of the cable 14. The other end 14*a* of the cable is securely attached to the end 42 by looping the cable around a strain relief partition 46. As is evident from FIGS. 2 and 5, with the movable end 34 in its closed position, that is, fully inserted within the main portion of the housing, the free end of the cable is trapped at the junction of and between the main portion and movable end of the housing; the opening of the movable end (FIG. 3) permits removal or insertion of the cable.

Figure 4:
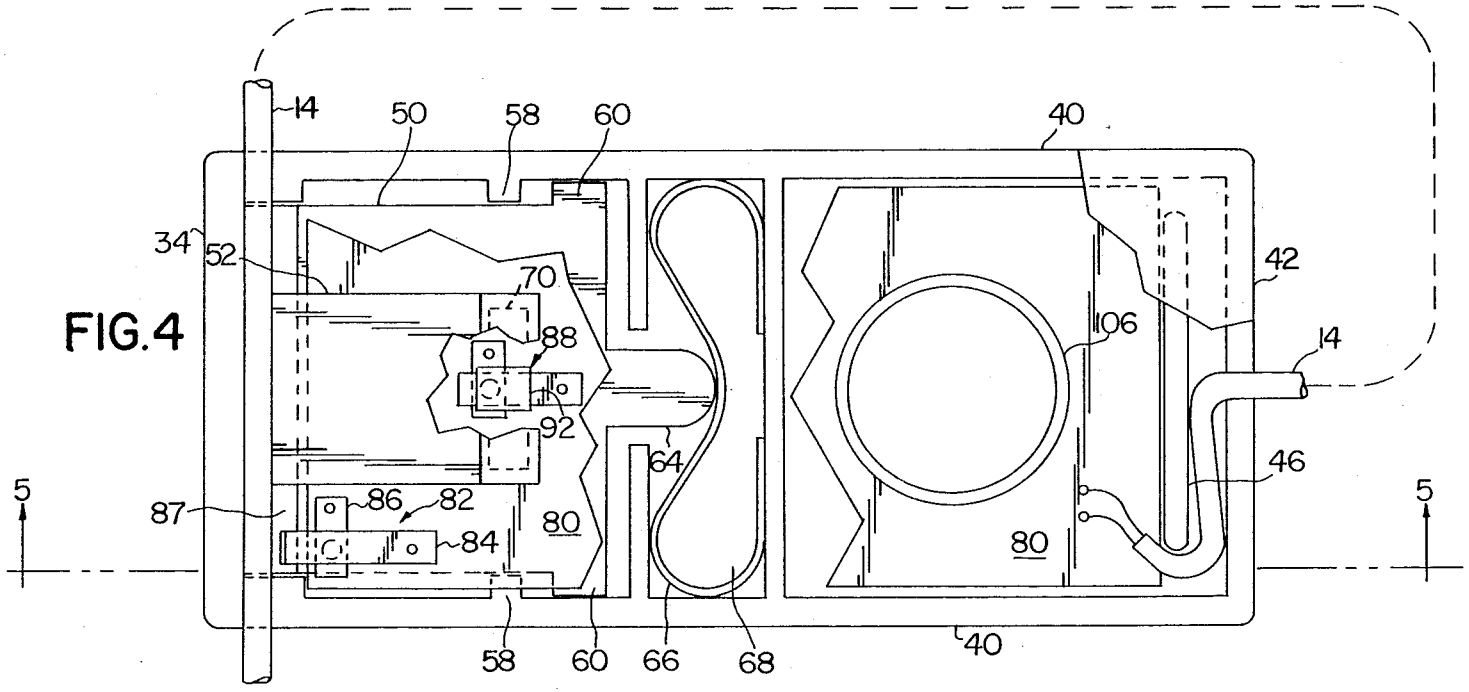
FIG. 4 is a top plan view, partly broken away, of the tag of FIG. 2 with the movable end portion in the closed, latched position.

The movable end 34 of the tag housing is a unitary, molded plastic component including a slide 50 and a cantilevered, resilient latch arm 52 having a key 54 at the inner end adapted to enter a recess 56 formed in the top wall 36 of the housing. The latch arm 52, key 54 and recess 56 form a spring-loaded catch; when the catch is disengaged, the movable end of the housing is slidable in and out of the main portion within limits imposed by inwardly projecting side wall abutments 58 engageable by ears 60 on the inner end of the slide. (FIGS. 4, 6 and 7.)

A finger 64 extending from the inner end of the slide 50 engages a leaf spring 66 held within a compartment 68 extending between the side walls of the housing. The spring 66 biases the movable end of the housing toward the open position and it will be seen that when the key 54 is unlatched, the end 34 is driven toward its open position permitting withdrawal or insertion of the cable. To effect unlatching of the movable end, the arm 52 is provided at its inner end with a ferromagnetic slug 70. (Alternatively, the arm 52 may be fabricated of a magnetizable spring steel material.) Placement of a strong magnet 72 (forming part of a cable removal fixture under the control of authorized personnel at a checkout counter) adjacent the bottom wall 38 is sufficient to pull the latch arm 52 down to free the movable end 34 which is pushed open under the urging of the spring 66.

Mounted within the tag housing over the slide 50 and spring compartment 68 is a printed circuit board (PCB) 80 carrying the components of a switched, active (i.e., battery powered) RF transmitter.

Figure 8:
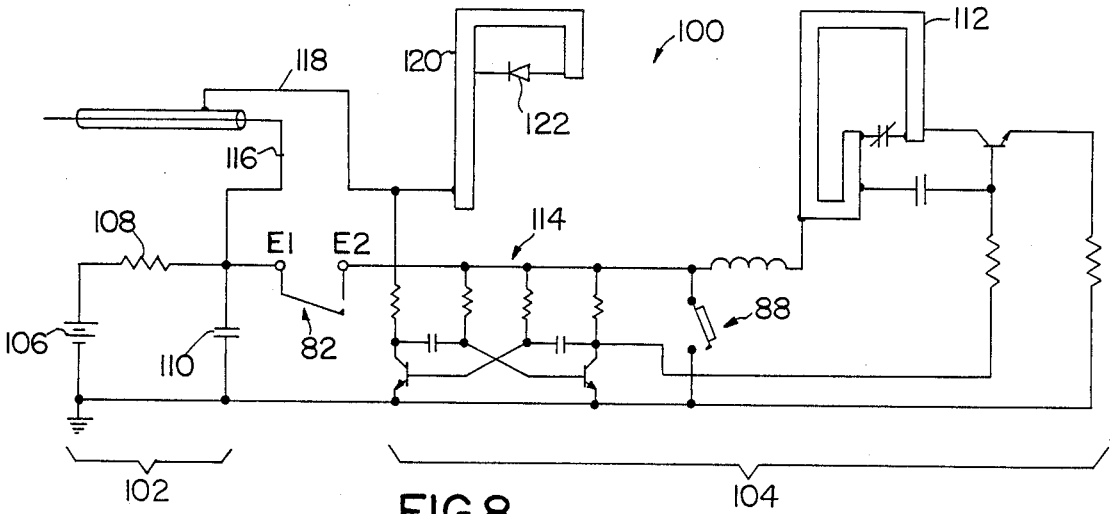
FIG. 8 is a schematic of the RF transmitter circuitry carried by the printed circuit board enclosed within the tag.

With reference now also to the electrical schematic of FIG. 8, mounted on the PCB 80 is a first switch 82 (normally closed) which senses the presence of the end portion 34, as shown in FIGS. 4–7. The sensing switch 82 is connected across terminals E1 and E2 in series with the transmitter 104 and has a pair of contacts 84 and 86, one of which (84) comprises a flat spring which rests on a projection 87 forming part of the end portion 34 so that with the end portion 34 in its closed, latched position, the first switch 82 is open (FIG. 5). Also mounted on the PCB 80 is a second switch 88 (normally open) having a contact 90 incorporating a ferromagnetic slug 92; with the removal fixture magnet 72 in place under the tag housing this contact is drawn down to close the second switch.

The cable 14 is preferably a length of standard coax cable which has sufficient tensile strength and has the desired electrical properties. As is well known, cable of this kind includes a center conductor surrounded by a conductive mesh-like shield, the two conductors being insulated from each other.

The electrical schematic, FIG. 8, shows a transmitter 100 and how the cable 14 and the sensing and magnetic switches 82 and 88 are incorporated therein.

The transmitter 100 comprises a power source 102 and a transmitter circuit 104. The power source 102 includes a 3-volt lithium battery 106 bonded to a surface of the PCB 80. Connected across the battery 106 is the series combination of a resistor 108 and a capacitor 110, the battery thereby normally maintaining the capacitor 110 in a charged state. The transmitter circuit 104 is connected across the capacitor through the sensing switch 82. The circuit further includes a flat, sheet metal antenna 112 which, when the circuit is powered, radiates a carrier signal which, for example, may be 300 MHz. The circuit also includes a modulator 114 which may take the form of an astable multivibrator having a free running frequency of 20 kHz in accordance with one practical example of the invention.

The magnetic switch 88 is connected in series with the sensor switch 82 so that when the tag is placed over the magnet 72 in a magnetic removal fixture and the cable is withdrawn from the tag housing, the sensing switch 82 and magnetic switch 88 are both closed thereby discharging the capacitor 110.

The cable center and shielding conductors, identified by the reference numerals 116 and 118, respectively, are connected across the sensing switch 82 so that if an attempt is made to cut the cable 14, the cable conductors will come into contact with each other thereby connecting the charged capacitor 110 to the transmitter circuit 104. Likewise, if the end portion 34 is somehow pulled out of the main portion of the housing in an attempt to remove the tag from the garment, the sensing switch 82 will close, energizing the transmitter circuit 104 from the energy stored in the capacitor 110. It will thus be seen that it is the charged capacitor 110 which powers the transmitter circuit 104; a 3.3 microfarad capacitor is sufficient to energize the transmitter to emit a modulated RF signal burst of about 25 millisecond duration. The battery 106 is utilized only to charge the capacitor slowly through large resistor 108 (e.g., 3.3 megohm) and its longevity therefore approaches shelf life (10 to 15 years).

Attached to the shielded conductor 118 of the cable 14 is a second, flat, sheet metal antenna 120 having a nonlinear device, such as a diode 122, connected across the legs thereof. The antenna 120, also disposed within the tag (for example, between the PCB and the top wall of the tag housing), is designed to interact with the exit monitoring system 22, 24 in a well known fashion in the event an attempt is made to carry the tagged garment 10 through the exit surveillance zone. Once again, reference in this regard is made to the inventor's prior patents identified above. By connecting the rebroadcast antenna 120 to the cable shielding 118, the antenna properties are enhanced and it becomes extremely difficult, if not impossible, to shield the entire tag and cable assembly while passing through the exit surveillance zone.

Figure 7A:
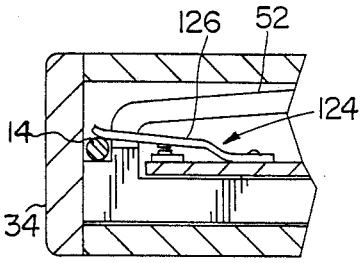
FIG. 7A is a side elevation view, partly in section, of an alternative embodiment of the tag shown in FIGS. 2–7.

FIG. 7A shows an alternative embodiment of the tag in which a switch 124 mounted on the PCB 80 includes a contact 126 resting on the cable 14 so that with the cable present within the housing 30, the switch 124 is open. If the cable is somehow pulled out of the housing in an attempt to remove the tag from the protected garment, the cable sensing switch 124 which, like switch 82, is connected across terminals E1 and E2, will close thereby energizing the transmitter 104. It will be evident that cable sensing switch 124 may be used instead of, or in addition to, the end portion sensing switch 82.

Figure 9:
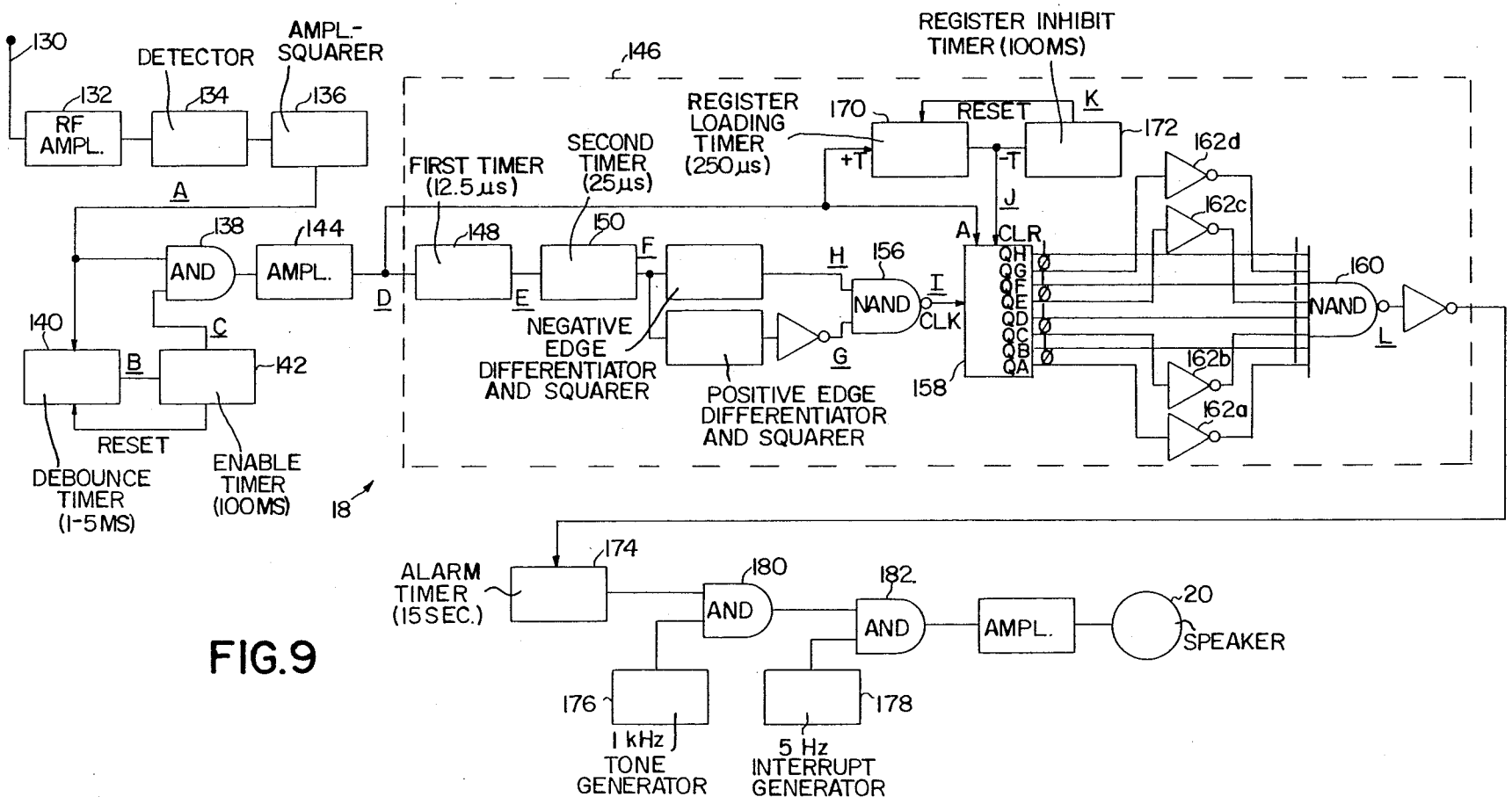
FIG. 9 is a block diagram of a receiver/processor forming part of the system shown in FIG. 1 for detecting an RF signal generated by the tag and processing that signal to provide an alarm output.
Figure 10:
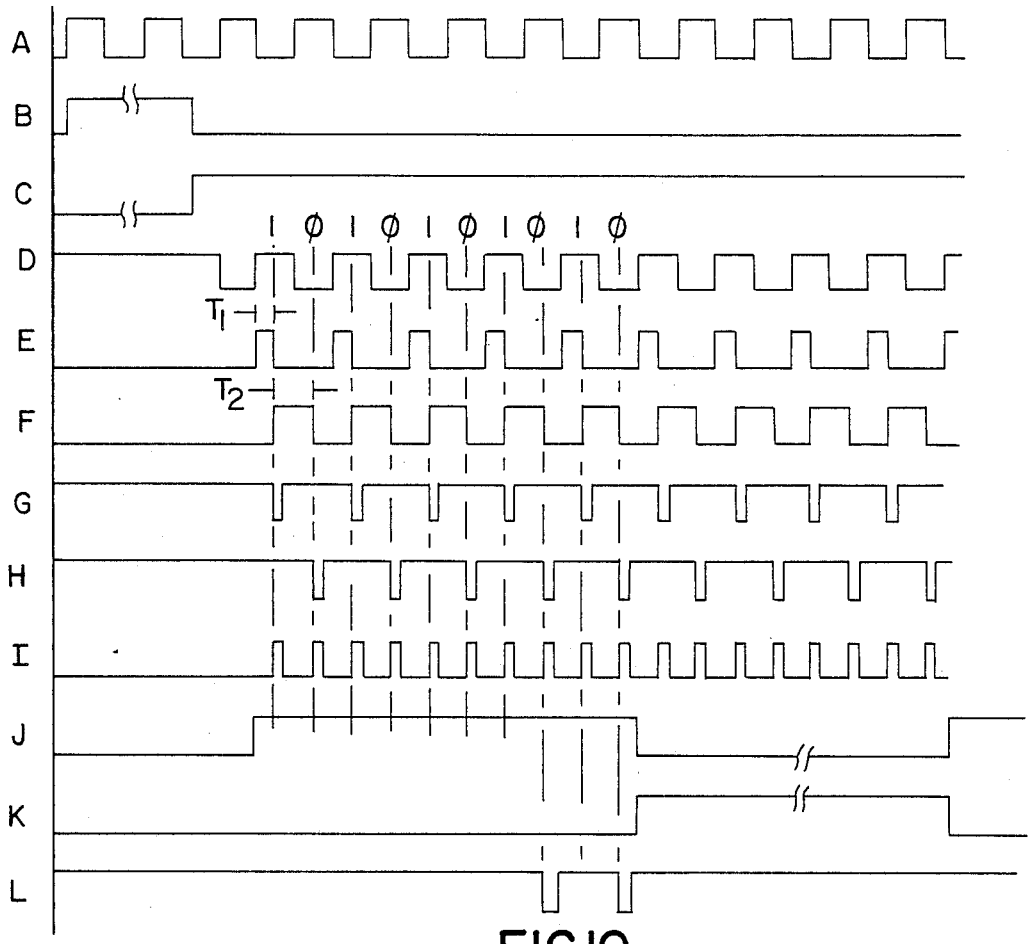
FIG. 10 is a timing diagram showing the waveforms present at various points in the receiver/processor.

FIG. 9 is a block diagram of the receiver/processor 18 for detecting and processing the 25 ms alarm signal burst generated by the tag, while FIG. 10 is a timing diagram showing the waveforms present at various points A–L in the receiver/processor 18.

An antenna 130 intercepts a received RF signal which is amplified by a broadband RF amplifier 132 having a 50 MHz bandwidth centered on the 300 MHz carrier signal, and a gain of +85 db. A crystal diode detector 134 demodulates the amplifier output and the demodulated signal is in turn amplified and squared by an amplifier 136 to produce a processor input signal in the form of a pulse train. (Waveform A, FIG. 10) The input signal is applied both to a terminal of an AND gate 138 and to the trigger of a debounce timer in the form of a monostable multivibrator 140 which introduces a delay of a 1–5 ms (waveform B) to allow for settling of the tag switch contacts. The termination of the debounce delay triggers a monostable multivibrator 142 which generates a 100 ms timing pulse (waveform C) for enabling the AND 138 gate to pass the input signal to an inverting amplifier 144. The squared, inverted pulse train at the output of the amplifier 144 will be referred to as the data signal (waveform D) which, as shown in FIG. 9, comprises the input to a data signal processor 146. When the input signal is the 20 kHz modulation frequency, the frequency of the data signal translates into a period of 50 microseconds. The data signal is applied to a first monostable multivibrator or timer 148 which is triggered by each low to high or positive transition of the data signal to produce a positive-going pulse having, where the tag transmitter modulation frequency is 20 kHz, a width $T_1 = 12.5$ microseconds (waveform E). The trailing or negative edge of each of these pulses triggers a second monostable multivibrator or timer 150 which produces 25 microsecond pulses ($T_2$) (waveform F) the positive and negative edges of which are centered on the high and low portions (binary 1 and 0) of the data signal pulses when those pulses have a frequency of 20 kHz.

The positive and negative edges of the output pulses of the second monostable timer 150 are differentiated, inverted and squared (see waveforms G and H in FIG. 10) and applied to a NAND gate 156 whose output (waveform I) is a series of positive pulses occurring at twice the data signal frequency and whose rising edges, for a data signal frequency of 20 kHz, are centered on the high and low portions (binary 1 and 0) of the data signal. The output of the NAND gate 156 is connected to the clock terminal CLK of an 8-bit serial input, parallel output shift register 158 (for example, TTL logic type number 74LS164), while the data signal is applied to one of the data inputs (A) of the register 158. Since clocking of the register 158 is on the positive clock edge, and with these edges aligned with alternate high and low levels of the data signal (when that signal is at 20 kHz), a serial string of alternating binary ones and zeros is entered into the register. Alternate register outputs QB, QD, QF and QH are each connected directly to an input of a NAND gate 160, while the remaining register outputs QA, QC, QE and QG are connected to respective inputs of the NAND gate through respective inverters **162*a*–162*d*. Accordingly, if the contents of the register 158 at any time during the loading period are binary 0, 1, 0, 1, 0, 1, 0, 1 (in the direction of QA-QH), the output of the NAND gate 160 will be low, indicative of an alarm condition (see waveform L). It will be appreciated that if the contents of the register fail to conform to the aforementioned alternating pattern during the entire period that data is being read, the output of the NAND gate 160 will remain high thereby inhibiting the alarm. Thus, the processor 146 functions as a frequency sensitive detection system. Because the pulse width of the second timer 150 is independent of the data signal and is used to generate the clock pulses, changes of sufficient magnitude of the frequency of the data signal will cause the contents of the register 158 to depart from the alternating pattern described above and result in failure of the "all ones" condition at the input of the NAND gate 160. The degree of variation in the frequency of the data signal that is tolerated while still producing the alternating register output pattern depends on the setting of the pulse widths $T_1$ and $T_2$ of the first and second timers 148 and 150**. A data signal frequency of 20 kHz and first and second timer pulse widths of $T_1 = 12.5$ microseconds and $T_2 = 25$ microseconds, respectively, corresponding to one-quarter and one-half of the period of the data signal, allow the transmitted frequency the greatest latitude: the frequency range within which an alarm response will be generated is about 13.33–26.67 kHz, a relatively broad bandwidth. The bandwidth can be narrowed by, for example, decreasing $T_1$ and increasing $T_2$.

To further restrict alarm conditions and minimize chances of false alarms, the output of a register loading timer in the form of a monostable multi-vibrator 170 (waveform J) having a time constant of, say, 250 microseconds, is applied to the clear terminal (CLR) of the register 158 to enable the register for a time equal to about 10 clock pulses. Another monostable multivibrator 172, functioning as a register loading inhibit timer, is connected to inhibit the monostable 170 for 100 ms intervals so as to limit the "try loading" cycle of the shift register to 250 microseconds in every 100 ms (waveform K). The constraints that can be placed on the frequency and register loading time "windows" insure extremely reliable, error-free operation.

The output of the NAND gate 160 is inverted and applied to the positive trigger terminal of a monostable multivibrator 174 functioning as an alarm timer generating an output pulse of 15 seconds or longer. The outputs of a 1 kHz alarm pulse tone generator 176 and a 5 Hz interrupt pulse generator 178 are combined with the alarm timer output by means of AND gates 180 and 182 to produce an unmistakable, commanding audible alarm from the amplifier-driven speaker 20.

FIGS. 11–15 show another type of security system incorporating an alternative embodiment of the receiver/processor of the present invention. The main components of the system, shown in FIG. 11, include a sensor loop 190 passed through the sleeve of a protected garment 192 and coupled to a multichannel header or manifold unit 194; a control unit 196 connected to the manifold unit; and a remote receiver/processor 198 coupled to drive a speaker 200 or other alarm device. The basic system is disclosed in U.S. Pat. No. 4,746,909, incorporated herein by reference. Generally, the manifold unit circuitry 202, shown in accompanying FIG. 12 and in FIG. 6 of U.S. Pat. No. 4,746,909, operates to sense a change in condition in the sensor loop 190 or the related circuitry. Such change will occur if a connected loop 190 is disconnected or severed; if a disconnected loop is connected; if a disconnected battery power supply ($+V_{CC}$) is connected; if a manifold unit 194 is added or removed; and so forth. Virtually any tampering with the system is detected and causes an output signal to appear on the alarm line 204 which is connected via a plug 206 and a jack 208 (FIG. 13A) to the control unit 196, thereby latching an alarm circuit 210 shown here in FIGS. 13A and 13B and in FIGS. 7A and 7B of U.S. Pat. No. 4,746,909.

The latching alarm circuit 210 generates an alarm signal which appears as a high level (binary 1) signal at the output (**150*c* in the '909 patent) of a NAND gate 212 (150 in the '909 patent). In the '909 patent, the alarm signal energizes an alarm circuit which is incorporated in the control unit and is driven by the battery power supply of that unit. Because the alarm circuit of the '909 patent draws substantial current, battery life is limited even if relatively few alarm conditions occur. In the present invention, the alarm signal at the output of the latching circuit NAND gate 212 is used instead to energize an RF transmitter circuit which generates a field to which the receiver/processor 198** responds and which has extremely low power requirements.

Figure 13A:
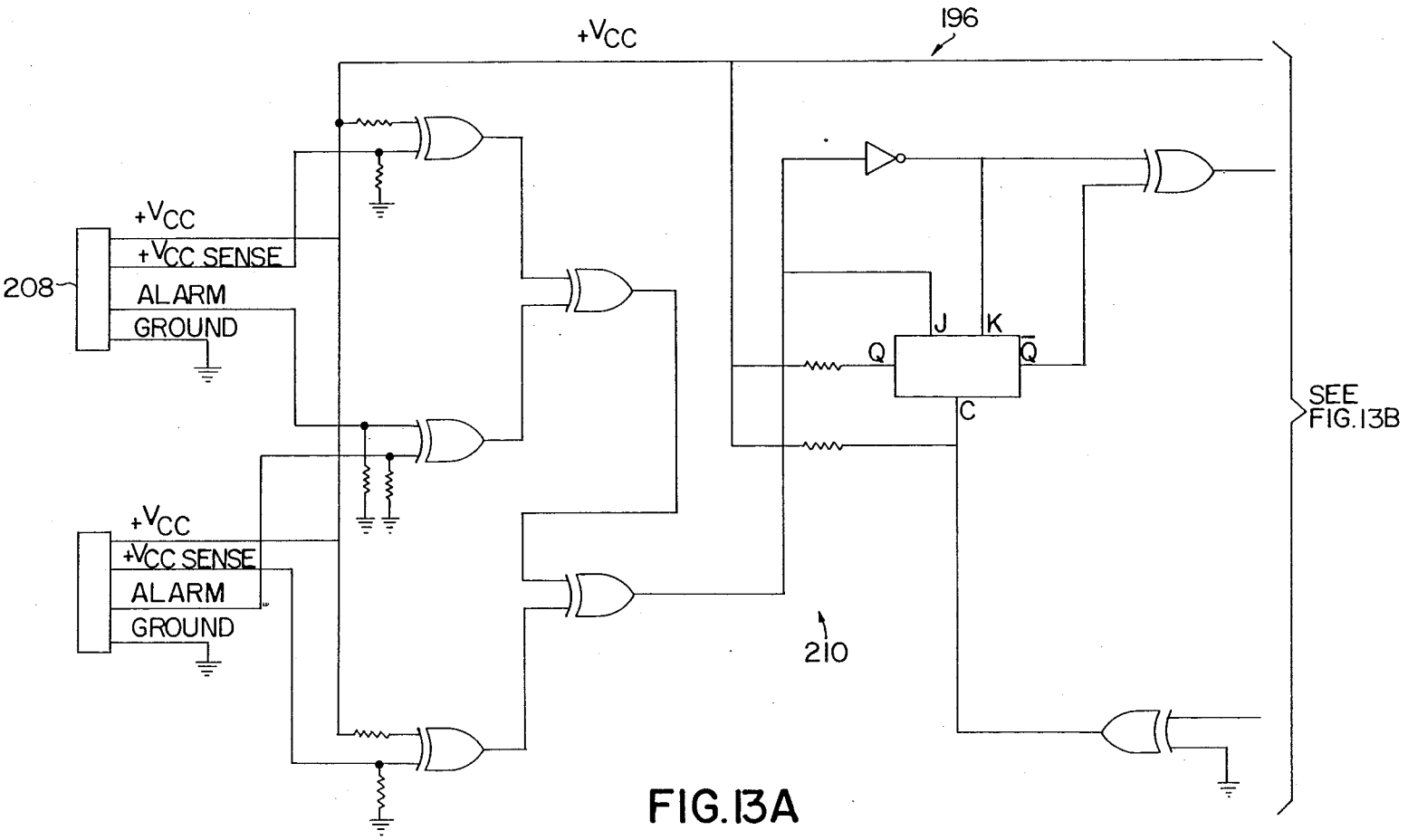
FIGS. 13A and 13B together comprise a schematic diagram of latching and alarm circuits within the control unit of the system of FIG. 11.
Figure 13B:
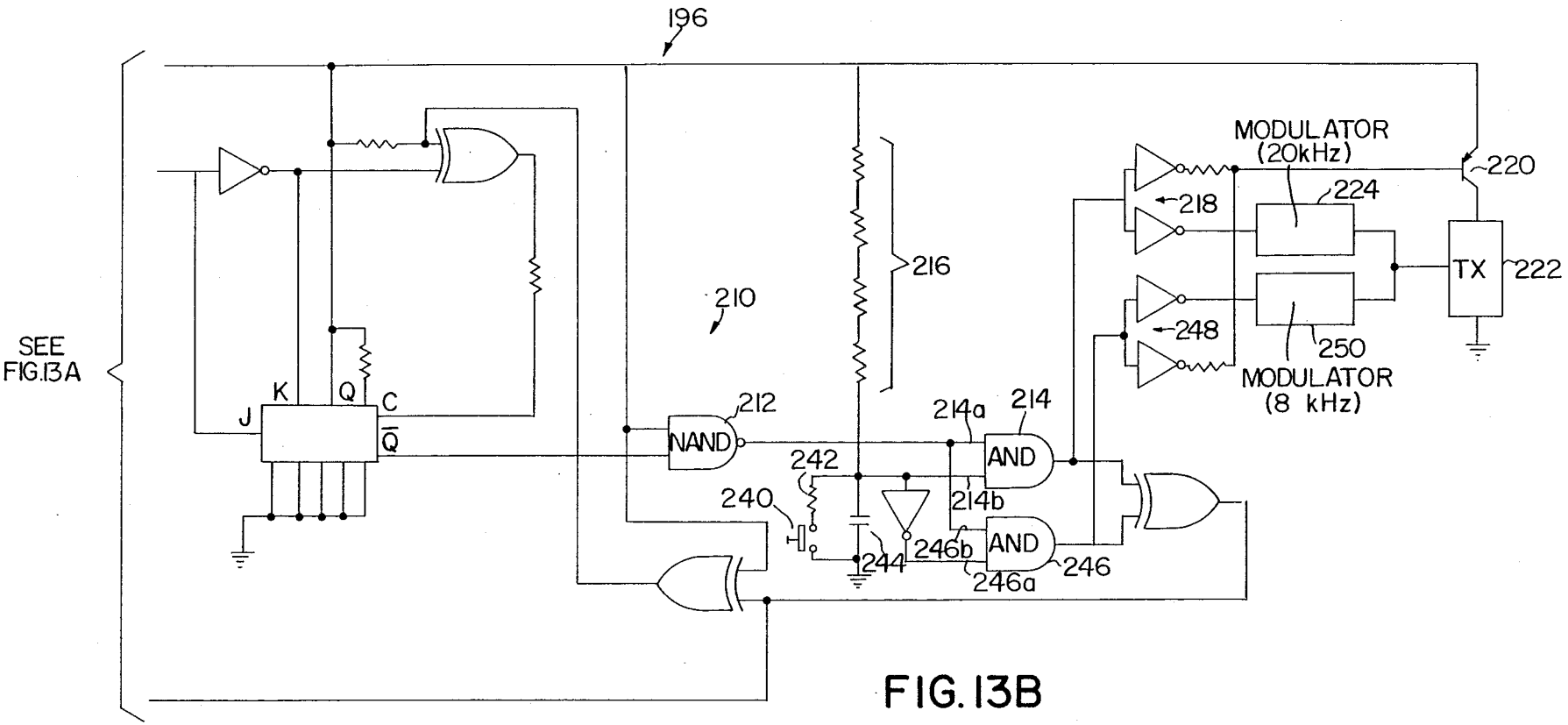

More particularly, and with reference to FIG. 13B, the alarm signal is applied to an input terminal **214*a* of an AND gate 214 whose other input terminal 214*b* is normally maintained "high" through a pull up resistor network 216. The output of the AND gate 214 is connected to a first pair of inverters 218, one of which turns on a transistor switch 220 to power an RF transmitter 222, and the other of which energizes a 20 kHz modulator 224** identical to that used in the tag circuit of FIG.

8. The circuit of the RF transmitter 222 is shown in FIG. 14 and is identical to the antenna 112 and related circuitry in FIG. 8.

Figure 15:
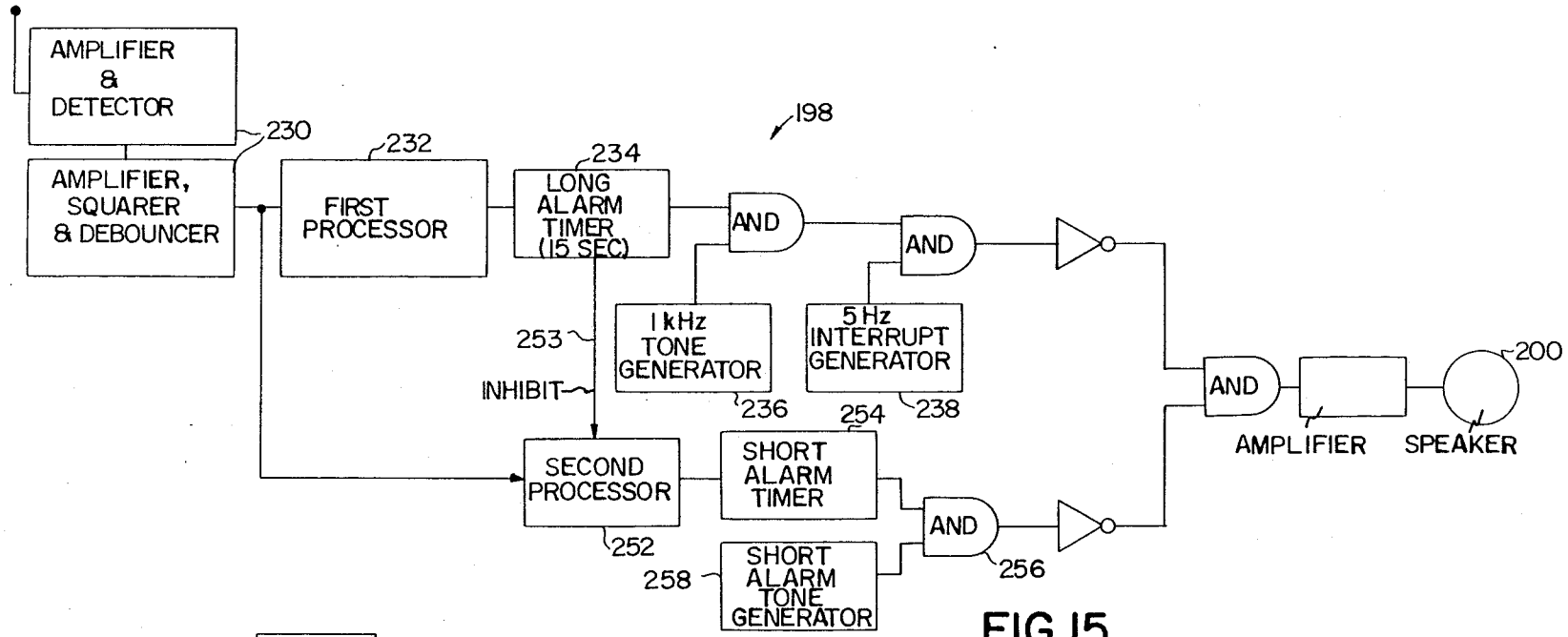
FIG. 15 is a block diagram of a receiver/processor employed in the system shown in FIG. 11.

As shown in FIG. 15, the 20 kHz-modulated RF signal is amplified, detected, debounced and squared by circuits 230 identical to that already described, and then processed by a first processor 232 which generates a main or long alarm signal by way of a timer 234, tone and interrupt generators 236 and 238, and so forth, all as previously described in connection with FIG. 9. The main or long alarm alerts store personnel that an unauthorized attempt has been made to remove the garment 192 or otherwise tamper with the sensor loop system.

Figure 14:
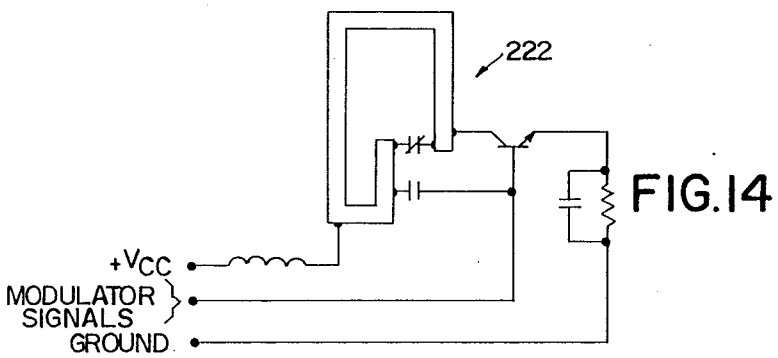
FIG. 14 is a schematic diagram of a transmitter circuit used in the system of FIG. 11.

The apparatus of FIGS. 13B, 14 and 15 is also used, however, to produce a "short" alarm which signals the authorized disconnection or connection of the sensor loop 190 from the manifold unit 194, for example, to allow a customer to try on the protected garment 192. The salesperson momentarily presses a hidden pushbutton switch 240 (which may be mounted on the control unit 196) which forms part of an RC network 242, 244 in the control unit (FIG. 13B). The momentary closing of the pushbutton switch 240 discharges the capacitor 244, pulling the input **214*b* to the AND gate 214 "low". The complement of this signal is applied to an input 246*a* of a second AND gate 246 whose output goes "high" and, by way of a second pair of inverters 248, turns on the transistor 220 and thereby the 300 MHz RF transmitter 222 as well as a low frequency modulator 250 comprising, for example, an astable multivibrator (like the 20 kHz modulator) having a free running frequency of 8 kHz. The received RF signal is demodulated and otherwise processed by circuits 230 to produce input and data signals in the manner already described. The 8 kHz data signal is processed by a second processor 252, identical to the first processor 232, except that its first and second monostable multivibrator timer pulse widths are preset to detect the 8 kHz data signal. The second processor 252 is inhibited via the line 253 from the timer 234 during operation of the first or main alarm processor 232. The alarm output of the second processor triggers a "short alarm" timer 254 having, for example, a 1–2 second time constant which in turn enables an AND gate 256 for passing the signal from a "short alarm" tone generator 258 to an appropriate alarm device such as the speaker 200**. The tone generated by the "short alarm" circuitry is of substantially less duration and has a "softer" sound than the main alarm.

Figure 11:
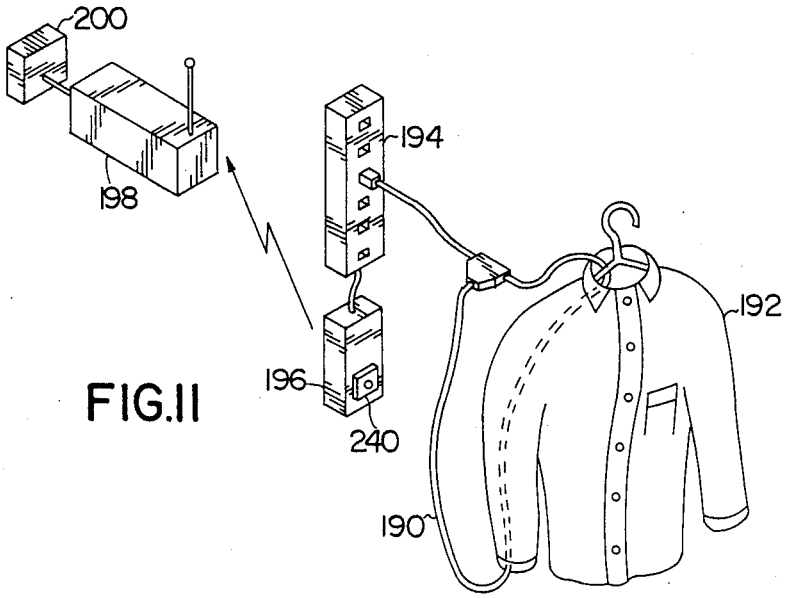
FIG. 11 is a perspective view of the basic components of a sensor loop security system in accordance with an alternative embodiment of the invention.
Figure 12:
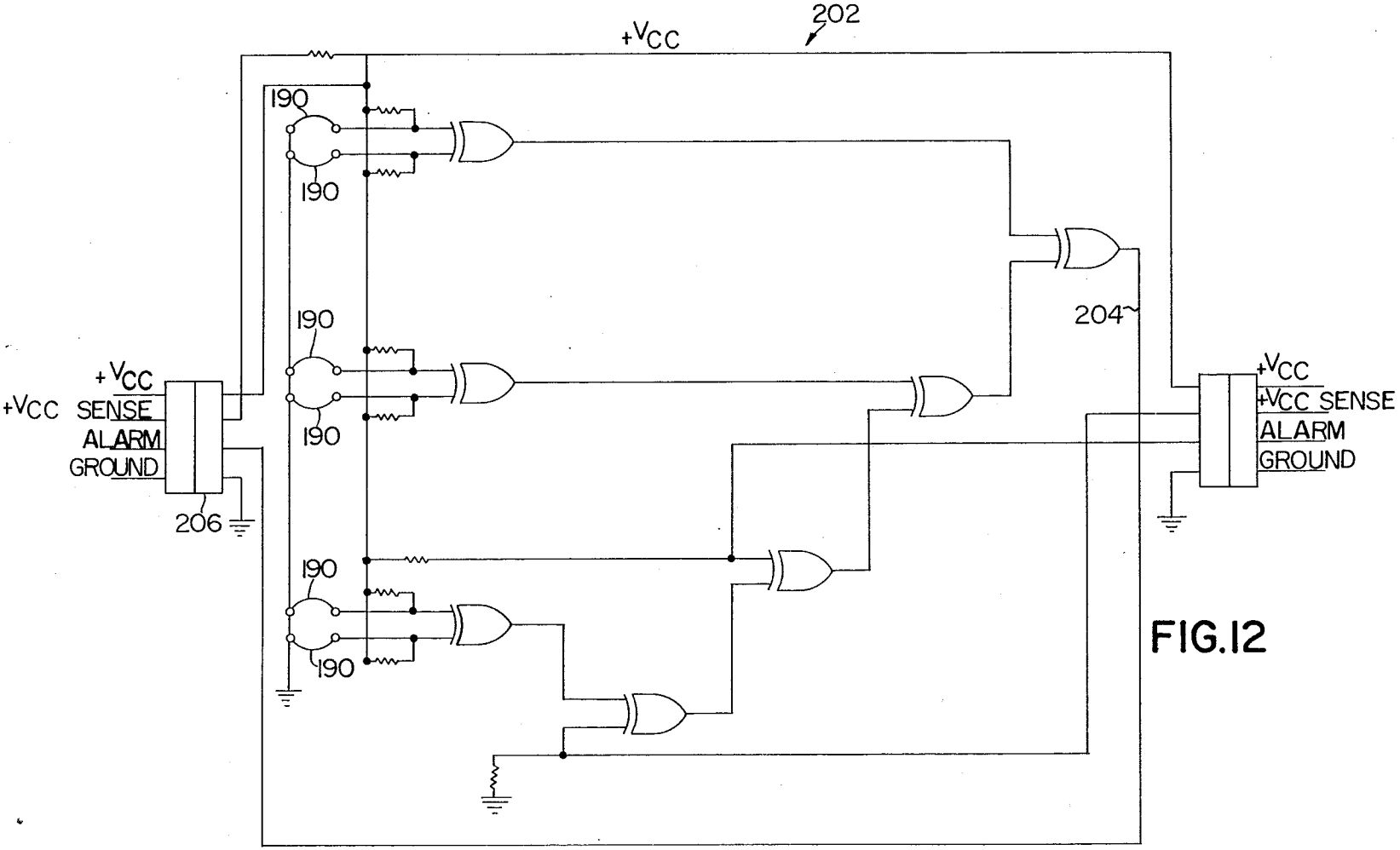
FIG. 12 is a schematic diagram of a detection circuit contained in a header or manifold unit used in the system of FIG. 11.
Figure 16:
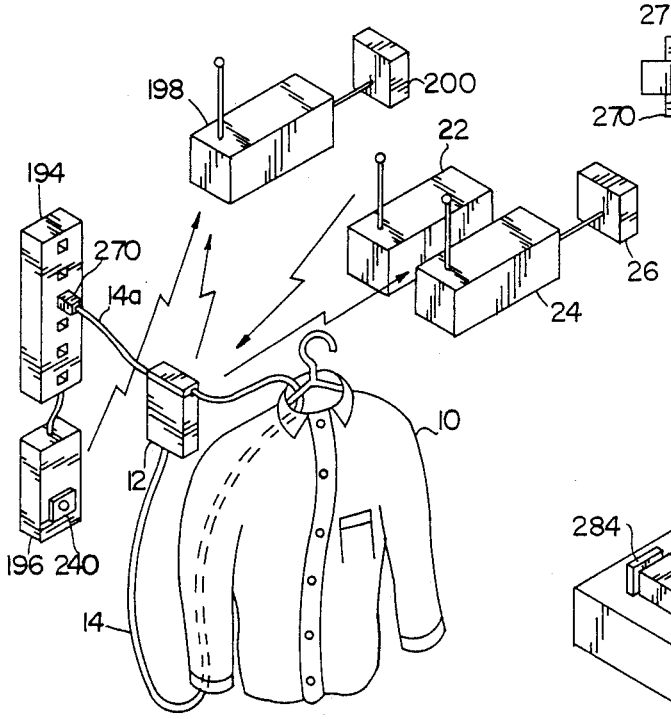
FIG. 16 a perspective view of the basic components of a security system in accordance with yet another embodiment of the invention.
Figure 17:
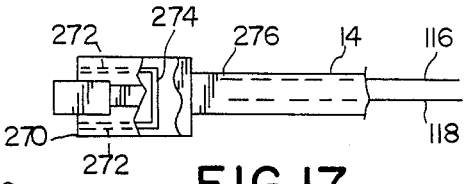
FIG. 17 is a top view of a modular plug attached to the free end of the cable used in the system of FIG. 16.

FIGS. 16 and 17 show yet another embodiment of a security system in accordance with the invention. The system of FIGS. 16 and 17 is basically a combination of those shown in FIGS. 1 and 11, furnishes maximum security and is particularly useful for protecting expensive garments. (Reference numerals identical to those used in FIGS. 1 and 11 are used to identify the same or similar elements in FIGS. 16 and 17.) The free end **14*a* of the cable 14, which is attached to the transmitter tag 12 and looped through the garment 10 to be protected, is provided with a standard modular phone plug 270 for connection to a manifold unit 194 which in turn is coupled to a control unit 196. The plug 270 has a pair of terminals 272 bridged by a shorting wire 274 so that the shorted plug functions similarly to the sensor loop 190 of the system shown in FIGS. 11 and 12. With reference to FIG. 17, it will be seen that the conductors 116 and 118 of the cable 14 terminate at a point 276 short of the plug 270 so that the tag/loop and sensor loop systems function in the manners already described and independently of each other. Accordingly, any attempt to cut the cable 14 or tamper with the loop sensor system is sensed by the receiver/processor 198. The garment 10 can, however, be removed from the manifold unit 194 by authorized personnel as already described by pressing the pushbutton 240 on the control unit, but any attempt to carry the tagged garment 10 through the surveillance zone will be detected by the exit monitoring system 22, 24, 26**.

Figure 18:
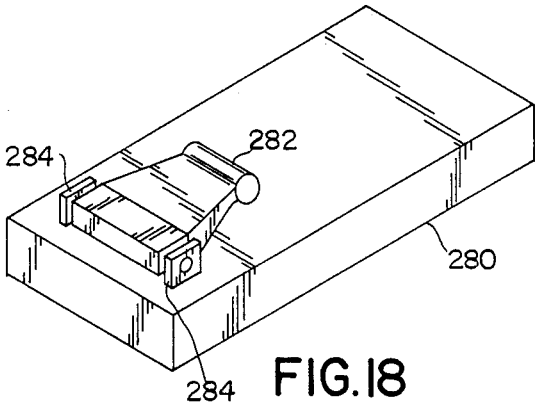
FIG. 18 is a perspective view of an alternative embodiment of the tag of the present invention utilizing a movable clip for attaching the tag to a protected article.
Figure 19:
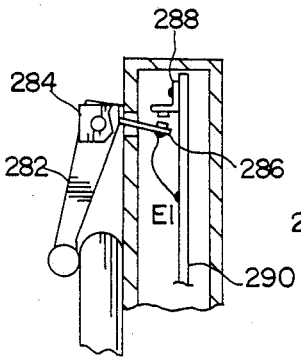
FIGS. 19 and 20 are side views, in section, of a portion of the tag of FIG. 18.
Figure 20:
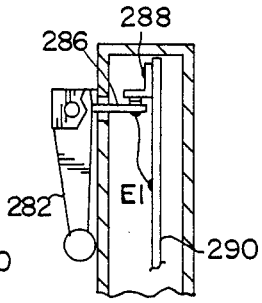

FIGS. 18–20 show an alternative embodiment of the active security tag of the invention. The alternative tag 280 includes a clip 282 pivotably mounted in a pair of trunnions 284 and spring loaded so that it normally lies against the tag housing (FIG. 20). A contact arm 286 on the movable clip extends into the tag housing and cooperates with a stationary contact 288 mounted on a printed circuit board 290 inside the housing. The contact arm 286 is connected to a switch terminal E1 analogous to E1 on the PCB of FIG. 8 while the stationary contact is connected to a terminal (not shown in FIGS. 19 and 20), analogous to E2 in FIG. 8. As shown in FIG. 19, the contacts 286, 288 are open when the tag 280 is clipped to a protected article 292. It will be appreciated that removal of the tag from the article causes the contacts to close (FIG. 20) energizing the tag transmitter in the manner already described.

Figure 21:
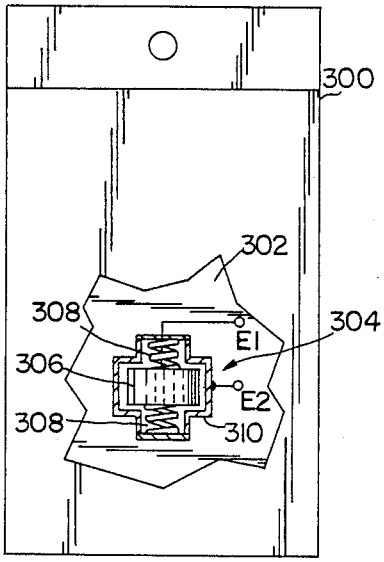
FIG. 21 is a top plan view, partly broken away, of a motion detecting tag in accordance with yet another embodiment of the tag of the present invention.

FIG. 21 shows yet another form 300 of the security tag of the invention useful as a motion detector attachable to a door, window or other object whose movement is to be monitored. Mounted on a printed circuit board 302 inside the tag 300 is a 3-axis motion sensor 304 which may take the form of a small metallic mass 306 supported by springs 308 inside a conductive casing 310. The mass and casing, which are normally out of contact, are connected to PCB points E1 and E2 analogous to E1 and E2 in the circuit of FIG. 8. Any movement of the tag 300 in any direction causes the mass 306 to make contact with the casing 310 energizing the tag transmitter and thereby triggering a remote alarm.

What is claimed is:

1. A security tag for attachment to an article of merchandise or the like, comprising:
   - a housing;
   - a battery enclosed within the housing;
   - a series combination of a capacitor and a resistor connected across the battery whereby the capacitor is charged by said battery through said resistor;
   - a radio frequency transmitter enclosed within the housing;
   - a pair of terminals disposed in series with said transmitter, the series combination of said terminals and transmitter being connected across said capacitor; and
   - means disposed across the terminals for electrically connecting the terminals in response to an alarm condition, connection of said terminals coupling the capacitor across said transmitter, the energy stored in said capacitor momentarily energizing the transmitter to radiate a radio frequency signal burst.

2. A security tag, as defined in claim 1, which includes:
   - a cable having one end affixed to the housing and a free end passing through the housing and slidable therein, the cable and housing forming a variable length closed loop for attaching the tag to the article, the cable including a pair of conductors normally insulated from each other and extending substantially the entire length of the cable, each conductor having an end at the fixed end of the cable, the end of one of the conductors being connected to one of said terminals and the end of the other of the conductors being connected to the other of said terminals, an attempt to cut the cable causing the conductors to come into contact with each other thereby energizing the transmitter.

3. A security tag, as defined in claim 2, in which:

the housing comprises a main portion and an end portion movable between an open, unlatched position and a closed, latched position relative to the main portion, the free end of the cable passing through the housing at the junction of the main and end portions, the cable being held by said portions when the end portion is in the closed position, the free end of the cable being insertable into and removable from the housing when the end portion is in the open position; and the terminal-connecting means comprises a switch within the housing responsive to the position of the end portion, the switch being closed when the end portion is moved to the open position.

4. A security tag, as defined in claim 3, in which:

the end portion of the housing includes a spring-loaded catch for engaging a recess in the main portion of the housing, the catch including a magnetic element;

and which includes:

a magnetic switch connected across the capacitor, the end portion catch being unlatched and the magnetic switch being closed to discharge the capacitor when the tag is positioned proximate a magnet, thereby permitting the authorized withdrawal of the cable from the housing.

5. A security tag, as defined in claim 2, in which:

the terminal connecting means comprises a switch operatively associated with the cable to close and thereby energize the transmitter when the free end of the cable is withdrawn from the housing.

6. A security tag, as defined in claim 1, which includes:

a clip pivotally mounted on the housing for attaching the tag to the article, the clip being biased to a position in which it lies against the housing;

and in which:

the terminal-connecting means comprises a switch within the housing, the switch being responsive to the position of the clip, the switch being open when the clip is pivoted away from the housing and closed when the clip is against the housing.

7. A security tag, as defined in claim 1, in which:

the terminal-connecting means includes a motion sensor within the housing, the motion sensor including a mass of conductive material suspended within a conductive casing, the mass being connected to one of the pair of terminals and the casing being connected to the remaining terminal, motion of the tag causing the mass to come into contact with the casing.

8. A security tag, as defined in claim 1, which includes:

a rebroadcast antenna within the housing adapted to interact with the transmitter and receiver of an exit monitoring system.

9. A security tag for attachment to an article of merchandise or the like, comprising:

a housing;

a radio frequency transmitter enclosed within the housing;

a source of electrical energy within the housing for energizing the transmitter; and a cable having one end affixed to the housing and a free end passing through the housing and slidable therein, the cable and housing forming a variable length closed loop for attaching the tag to the article, the cable including a pair of conductors extending substantially the entire length of the cable and being normally insulated from each other, the end of one of the conductors at the fixed end of the cable being connected to the transmitter and the end of the other of said conductors at the fixed end of the cable being connected to the electrical energy source, an attempt to cut the cable causing the conductors to come into contact with each other providing a conductive path between the electrical energy source and the transmitter thereby energizing the transmitter.

10. A method for detecting an attempted removal of a monitoring device from an article of merchandise or the like, the monitoring device including a transmitter for radiating a modulated radio frequency signal in response to said attempted removal, the method including the steps of:

producing input signal pulses in response to a received RF signal;

generating a first train of pulses of equal, predetermined width in response to and at the frequency of said input signal pulses;

generating a second train of pulses in response to and at twice the frequency of said first train of pulses;

entering the input signal pulses into a digital memory at the frequency of the second train of pulses;

monitoring the contents of the digital memory; and generating an alarm signal when the contents of said digital memory conform to a predetermined pattern, such conformity occurring when the frequency of the input signal pulses falls within a predetermined range.

11. A method, as defined in claim 10, which includes the step of:

periodically enabling the digital memory for a predetermined time interval to load the memory with a limited number of input signal pulses.

12. A method, as defined in claim 10, in which:

the predetermined pattern of the contents of the digital memory is the 8-bit binary sequence 0,1,0,1,0,1,0,1.

13. Apparatus for detecting an attempted removal of a monitoring device from an article of merchandise or the like, the monitoring device including a transmitter for radiating a modulated RF signal in response to said attempted removal, said apparatus comprising:

an RF receiver and demodulator;

means responsive to the receiver and demodulator for producing digital data signal pulses;

a first pulse generator responsive to said data signal pulses for producing a first train of pulses at the frequency of the data signal pulses, the pulses of said first train each having a first predetermined time width;

a second pulse generator responsive to said first pulse generator for producing a second train of pulses at the frequency of the data signal pulses, the pulses of said second train each having a second predetermined time width;

means responsive to said second pulse generator for producing a third train of pulses at a frequency twice that of said data signal pulse frequency;

a shift register having a data input terminal, a clock terminal and a plurality of output terminals, said data signal pulses being applied to the data input terminal to load said register, and said third train of pulses being applied to said clock terminal, said output terminals providing a pattern of output signals, said pattern being dependent on the value of the data signal pulse frequency, a predetermined pattern being present when the data signal pulse frequency is substantially equal to the modulation frequency of the transmitted RF signal;

means coupled to the output terminals of the shift register for monitoring the states of said output signals, said monitoring means having an output whose state is determined by the pattern of the shift register output signals, the state of the output of said monitoring means changing when said predetermined pattern of signals is present at the output terminals of the shift register; and means responsive to the output of the monitoring means for indicating the presence of said predetermined pattern of signals.

14. Apparatus, as defined in claim 13, in which:

the widths of the pulses of said first and second trains of pulses are selected to provide said predetermined pattern of shift register output signals when said data signal pulse frequency falls within a preselected range.

15. Apparatus, as defined in claim 14, which includes:

means for periodically enabling the shift register for a predetermined time interval whereby the register is loaded with a limited number of data signal pulses.

16. Apparatus, as defined in claim 13, in which:

the means for monitoring the states of said shift register output signals comprises a logic gate having input terminals coupled to receive said output signals.

17. Apparatus, as defined in claim 16, in which:

the predetermined pattern of signals present at the output terminals of the shift register is a sequence of alternating high and low levels.

18. Apparatus, as defined in claim 16, in which:

the means for monitoring the states of the output signals of the shift register includes a NAND gate;

the shift register is an 8-bit register; and the predetermined pattern of signals present at the output terminals is the bit sequence 0, 1, 0, 1, 0, 1, 0, 1, the 1-bits and the complements of the 0-bits being applied to corresponding inputs of the NAND gate.

19. A security tag comprising:

a housing including means for attaching the tag to an object to be monitored;

a battery enclosed within the housing;

the series combination of a capacitor and a resistor connected across the battery whereby the capacitor is charged by said battery through said resistor;

a radio frequency transmitter enclosed within the housing;

a pair of terminals disposed in series with said transmitter, the series combination of said terminals and transmitter being connected across said capacitor; and means disposed across the terminals for electrically connecting the terminals in response to an alarm condition, connection of said terminals coupling the capacitor across said transmitter, the energy stored in said capacitor momentarily energizing the transmitter to radiate a radio frequency signal burst.

* * * * *